US009033816B2

(12) United States Patent
Min et al.

(10) Patent No.: US 9,033,816 B2
(45) Date of Patent: May 19, 2015

(54) HYBRID GOLF SHAFT

(75) Inventors: Tae Kyoung Min, Paju-Si (KR); Tae Hwan Ahn, Seoul (KR); Eun Jung Cho, Seongnam-Si (KR); Jong Hyun Pack, Suwon-Si (KR); Jae Soo Choi, Suwon-Si (KR)

(73) Assignee: KOLON INDUSTRIES, INC, Gwacheon-si (KR)

( * ) Notice: Subject to any disclaimer, the term of this patent is extended or adjusted under 35 U.S.C. 154(b) by 160 days.

(21) Appl. No.: 13/993,803

(22) PCT Filed: Dec. 21, 2011

(86) PCT No.: PCT/KR2011/009905

§ 371 (c)(1), (2), (4) Date: Jun. 13, 2013

(87) PCT Pub. No.: WO2012/087010

PCT Pub. Date: Jun. 28, 2012

(65) Prior Publication Data

US 2013/0267344 A1 Oct. 10, 2013

(30) Foreign Application Priority Data

Dec. 22, 2010 (KR) ..... 10-2010-0132409
Oct. 19, 2011 (KR) ..... 10-2011-0107007
Oct. 19, 2011 (KR) ..... 10-2011-0107020

(51) Int. Cl.
*A63B 59/10* (2006.01)
*A63B 53/10* (2006.01)
*A63B 59/00* (2006.01)

(52) U.S. Cl.
CPC ..... *A63B 53/10* (2013.01); *A63B 2209/02* (2013.01); *A63B 59/0092* (2013.01); *A63B 2209/023* (2013.01)

(58) Field of Classification Search
CPC ..... A63B 2209/02; A63B 59/0092; A63B 53/10; A63B 2209/023
USPC ..... 473/318, 316, 319, 320, 321
See application file for complete search history.

(56) References Cited

U.S. PATENT DOCUMENTS

| | | | | | |
|---|---|---|---|---|---|
| 5,083,780 | A * | 1/1992 | Walton et al. | ..... | 473/320 |
| 5,634,861 | A * | 6/1997 | Yamamoto et al. | ..... | 473/319 |
| 5,964,056 | A * | 10/1999 | Grice | ..... | 43/18.5 |
| 6,273,830 | B1 * | 8/2001 | Takemura et al. | ..... | 473/319 |
| 6,306,047 | B1 * | 10/2001 | Kusumoto | ..... | 473/319 |
| 2005/0107182 | A1 | 5/2005 | Meyer et al. | | |
| 2010/0081516 | A1 | 4/2010 | Nakamura et al. | | |

FOREIGN PATENT DOCUMENTS

| | | | |
|---|---|---|---|
| JP | 10-230030 | A | 9/1998 |
| JP | 2008-154866 | A | 7/2008 |
| JP | 2010-75457 | A | 4/2010 |

* cited by examiner

*Primary Examiner* — Benjamin Layno
(74) *Attorney, Agent, or Firm* — Birch, Stewart, Kolasch & Birch, LLP

(57) ABSTRACT

Disclosed a hybrid golf shaft in which one or more aramid fiber containing prepregs (H) are laminated in a length section of 5 cm or more of the whole length of the golf shaft, and three or more carbon fiber prepregs (C) are laminated in a length section of 50 cm or more of the whole length of the golf shaft. The golf shaft is configured in that aramid prepregs (H1) or hybrid prepregs (H2) with excellent impact absorbability are arranged in a length section of 5 to 50 cm from a thin end of the golf shaft or along the whole length (L) in an axial direction of the golf shaft, to thereby effectively reduce the number of vibrations in the golf shaft when the golf ball is hit.

24 Claims, 3 Drawing Sheets

HYBRID GOLF SHAFT

TECHNICAL FIELD

The present invention relates to a hybrid golf shaft, and more specifically to a hybrid golf shaft, in which one or more aramid fiber containing prepreg layers with excellent impact absorbability are laminated near an end portion of the thin side (hereinafter referred to as a "tip end portion") of the golf shaft or along the whole length in an axial direction of the golf shaft, so that it is possible to remarkably decrease the number of vibrations in the golf shaft when the golf ball is hit.

Hereinafter, "hybrid prepregs" described in the present invention are defined as "prepregs" in which thermosetting resins are impregnated in a fiber laminate and reinforced with carbon fibers and aramid fibers arranged alternately and repeatedly.

BACKGROUND ART

There is a risk that a golfer be injured or the accuracy of shot be lowered in case of largely increasing the number of vibrations in a golf shaft when a golf ball is hit with the golf shaft. Therefore, a golf shaft is required to have a characteristic of decreasing the number of vibrations applied thereto when the golf ball is hit.

In order to reduce the weight of a golf shaft, a golf shaft composed of fiber-reinforced resins (also referred to as "prepregs") is frequently used.

As a conventional prepreg golf shaft, a prepreg golf shaft including triaxial fabric layers which are located at at least one end of the opposite end portions of the golf shaft is disclosed in U.S. Pat. No. 6,270,426.

Also, a carbon fiber golf shaft reinforced with a metal sheet near a tip end portion of the golf shaft is disclosed in Korean Patent Registration No. 10-0404713.

However, although the bending strength and torsional strength are improved in the above-mentioned conventional golf shafts, the effect of decreasing the number of vibrations in the golf shaft when the golf ball is hit is not obtained at all.

Further, although a golf shaft in which prepregs are included in all portions of the whole length in an axial direction of the golf shaft is widely used, the effect of decreasing the number of vibrations in the golf shaft when the golf ball is hit is not obtained at all.

DISCLOSURE

Technical Problem

In consideration of the above-mentioned problems, it is an object of the present invention to provide a hybrid golf shaft having an excellent effect of decreasing the number of vibrations in the golf shaft when the golf ball is hit.

Technical Solution

In order to accomplish the above-mentioned object, the present invention provides a hybrid golf shaft including: one or more aramid fiber containing prepregs (H) which are laminated in a length section of 5 cm or more of the whole length of the golf shaft; and three or more carbon prepregs (C) which are laminated in a length section of 50 cm or more of the whole length of the golf shaft.

Effect of Invention

According to the present invention, it is possible to protect the golfer from injury and provide an accuracy of shot by effectively decreasing the number of vibrations in the golf shaft when the golf ball is hit.

DESCRIPTION OF REFERENCE NUMERALS

S: golf shaft, $S_1$: tip end portion of golf shaft

L: whole length in axial direction of golf shaft

X: length section of 5 to 50 cm from tip end portion of golf shaft

Y: remaining section of golf shaft excluding the length section of 5 to 50 cm from the tip end portion of golf shaft M: mandrel, C: carbon fiber prepreg H: aramid fiber containing prepreg, H1: aramid prepreg H2: hybrid prepreg, P1: first process P2: second process, P3: third process V: hollow portion, Cf: carbon fiber Af: aramid fiber, W1: arrangement interval of carbon fiber W2: arrangement interval of aramid fiber.

Best Mode

Hereinafter, exemplary embodiments of the present invention will be described in detail with reference to the accompanying drawings.

Figure 1:
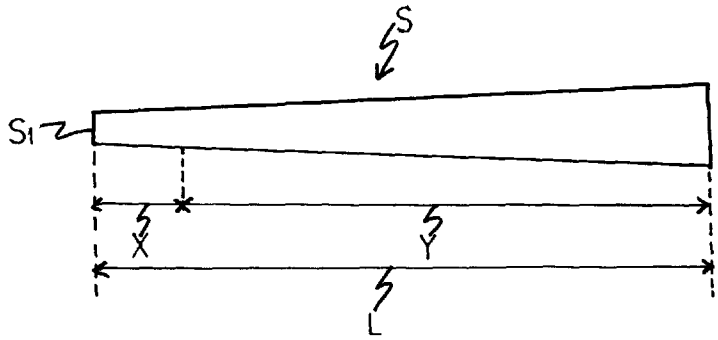
FIG. 1 is a longitudinal sectional view of a golf shaft of the present invention cut in an axial direction.
Figure 2:
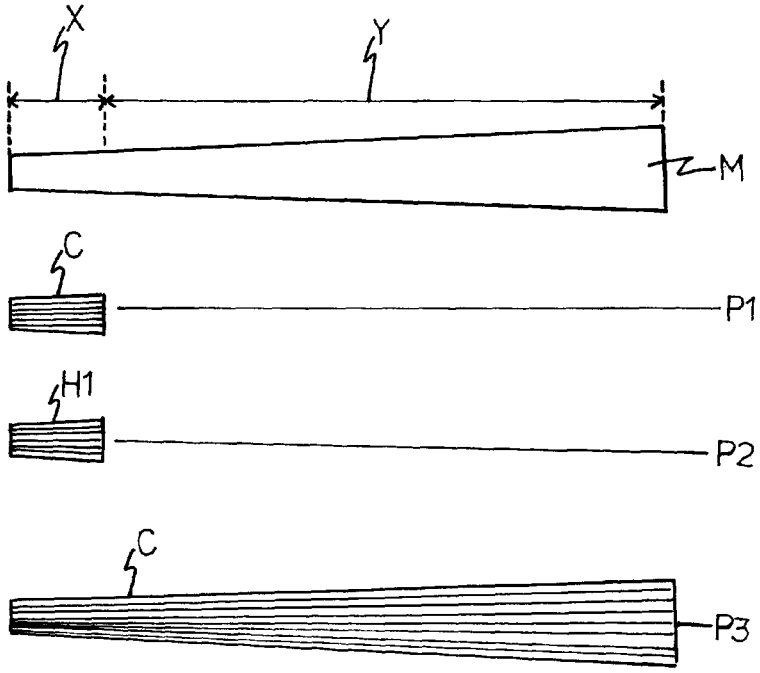
FIG. 2 is schematic views showing the sequence and process in which prepregs are applied to a mandrel to manufacture a hybrid golf shaft according to a first embodiment of the present invention.
Figure 3:
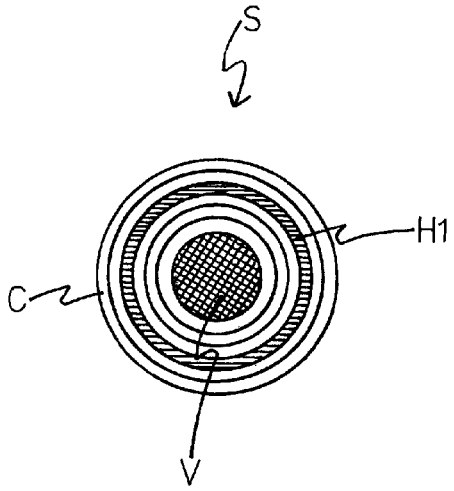
FIG. 3 is a cross sectional view of a hybrid golf shaft according to a second embodiment of the present invention cut in a radial direction.
Figure 4:
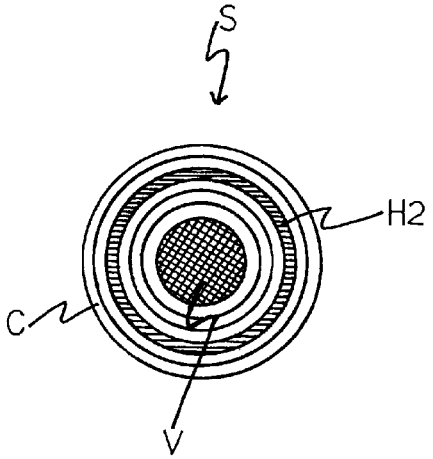
FIG. 4 is a cross sectional view of a hybrid golf shaft according to a third embodiment of the present invention cut in the radial direction.

A golf shaft S according to the present invention has a structure that one or more aramid fiber containing prepregs (H) are laminated in a length section of 5 cm or more of the whole length of the golf shaft and three or more carbon prepregs (C) are laminated in a length section of 50 cm or more of the whole length of the golf shaft, as shown in FIGS. 2 to 4.

The aramid fiber containing prepreg (H) is an aramid prepreg H1 which includes aramid fibers Af only or a hybrid prepreg H2 which includes aramid fibers Af and carbon fibers Cf.

The hybrid golf shaft according to a first embodiment of the present invention has a structure in which the carbon fiber prepregs C and the aramid prepregs H1 are laminated in a length section X of 5 to 50 cm from a tip end portion of the golf shaft $S_1$.

It is more preferable that the aramid prepregs H1 be of a structure laminated between the carbon fiber prepregs C so as to decrease the number of vibrations in the golf shaft when the golf ball is hit.

The hybrid golf shaft S according to the present invention has a structure in which only the carbon fiber prepregs C are laminated in a remaining section Y of the golf shaft excluding the length section X of 5 to 50 cm from the tip end portion of the golf shaft.

Preferably, the respective number of the aramid prepregs H1 and the carbon fiber prepregs C laminated in the length section X of 5 to 50 cm from the tip end portion of the golf shaft $S_1$ is 1 to 15.

Preferably, the number of carbon fiber prepregs C laminated in the remaining section Y of the golf shaft excluding the length section X of 5 to 50 cm from the tip end portion of the golf shaft $S_1$ is 3 to 30.

Preferably, the carbon fibers contained in the carbon fiber prepregs C and the aramid fibers contained in the aramid prepregs H1 are arranged in unidirection in a resin, respectively.

Preferably, the carbon fiber prepreg C includes 30 to 70 wt % of carbon fibers and 70 to 30% of the thermosetting resin.

The thermosetting resin may include an epoxy resin, etc.

Preferably, the aramid prepregs H1 includes 30 to 70 wt % of aramid fibers and 70 to 30% of the thermosetting resin.

The thermosetting resin may include an epoxy resin, etc.

Preferably, the respective thickness of the carbon fiber prepreg C and the aramid prepreg H1 is 50 to 300 μm.

It is preferable that the fineness of the aramid fiber be 500 to 3,000 deniers and the fineness of the carbon fiber be 3,000 to 12,000 deniers.

Next, one example of manufacturing the hybrid golf shaft according to the first embodiment of the present invention will be described with reference to FIG. 2.

First, a first process (P1), in which the above mentioned carbon fiber prepreg C is wound one time in the length section X of 5 to 50 cm from the tip end portion of a mandrel M, is carried out.

Next, a second process (P2), in which the aramid prepreg H1 is wound one time in the length section X of 5 to 50 cm from the tip end portion of the mandrel M, is carried out.

Next, a third process (P3), in which the above mentioned carbon fiber prepreg C is wound one time in the whole section of the mandrel M, that is, both the X section and Y section, is carried out ten times repeatedly, and then the mandrel and the prepreg laminated layer formed on the mandrel are separated after the resin in the prepreg is hardened in a hot-air oven, to manufacture a hybrid golf shaft.

As another example of the manufacturing method, one cyclic process, in which the first process is carried out one time, the second process is carried out one time, and the third process is carried out ten times, is repeated two to five times, and then the mandrel and the prepreg laminated layer formed on the mandrel are separated after the resin in the prepreg is hardened in the hot-air oven, to manufacture a hybrid golf shaft.

The hybrid golf shaft S according to a second embodiment of the present invention has a structure in which three or more carbon fiber prepregs C and one or more aramid prepregs H1 are laminated along the whole length L in an axial direction of the golf shaft, as illustrated in FIG. 3.

It is more preferable that the aramid prepregs H1 be of a structure laminated between the carbon fiber prepregs C as illustrated in FIG. 3 for decreasing the number of vibrations in the golf shaft when the golf ball is hit. However, in the present invention, the lamination position of the aramid prepregs H1 is not particularly limited.

Meanwhile, it is preferable that the carbon fiber prepregs C composing the golf shaft, that is, the number of carbon fiber prepregs C laminated along the whole length L in the axial direction of the golf shaft, be 5 to 30.

Further, it is preferable that the number of the aramid prepregs H1 composing the golf shaft be 1 to 10.

Preferably, the carbon fibers contained in the carbon fiber prepregs C and the aramid fibers contained in the aramid prepregs H1 are arranged in unidirection in a resin, respectively.

Preferably, the carbon fiber prepreg C includes 30 to 70 wt % of carbon fibers and 70 to 30% of the thermosetting resin.

The thermosetting resin may include an epoxy resin, etc.

Preferably, the aramid prepregs H1 includes 30 to 70 wt % of aramid fibers and 70 to 30% of the thermosetting resin.

The thermosetting resin may include an epoxy resin, etc.

Preferably, the respective thickness of the carbon fiber prepreg C and the aramid prepreg H1 is 50 to 300 μm.

It is preferable that the fineness of the aramid fiber be 500 to 3,000 deniers and the fineness of the carbon fiber be 3,000 to 12,000 deniers.

Next, an example of manufacturing a hybrid golf shaft according to the second embodiment of the present invention will be described.

First, a first process, in which the above mentioned carbon fiber prepreg C is wound one time along the whole length L in the axial direction of the mandrel, is carried out two to ten times repeatedly.

Next, a second process, in which the aramid prepreg H1 is wound one time over the carbon fiber prepreg C wound on the mandrel by the first process, is carried out one to ten times.

Next, a third process, in which the above mentioned carbon fiber prepreg C is wound one time over the aramid prepreg H1 wound on the mandrel M by the second process is carried out one to twenty times repeatedly, and then the mandrel and the prepreg laminated layer formed on the mandrel are separated after the resin in the prepreg is hardened in a hot-air oven, to manufacture a hybrid golf shaft.

Figure 5:
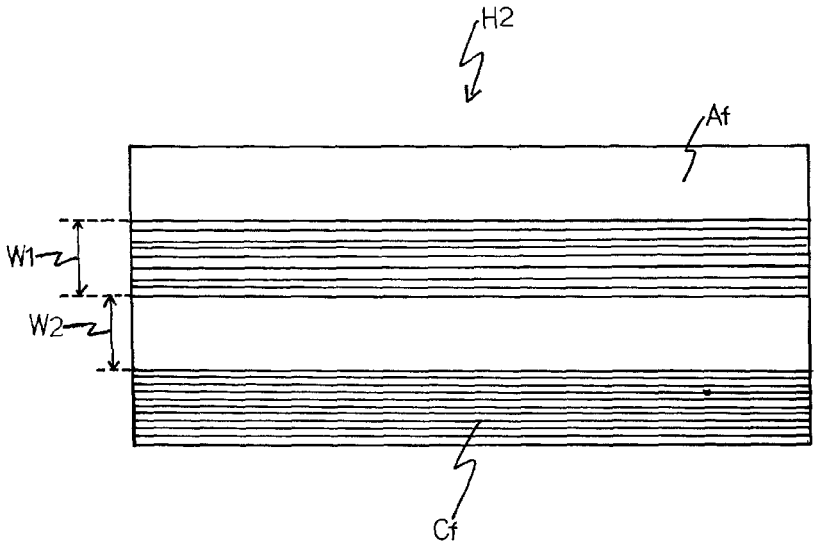
FIG. 5 is a plane view schematically showing the arrangement state of fibers in a hybrid prepreg H2 used for the third embodiment of the present invention.

The hybrid golf shaft S according to the third embodiment of the present invention has a structure, (i) three or more carbon fiber prepregs C and (ii) one or more hybrid prepregs H2 including the carbon fibers Cf and the aramid fibers Af are laminated along the whole length L in the axial direction of the golf shaft, as illustrated in FIGS. 4 and 5.

It is more preferable that the hybrid prepregs H2 be of a structure laminated between the carbon fiber prepregs C as illustrated in FIG. 4 for decreasing the number of vibrations in the golf shaft when the golf ball is hit. However, in the present invention, the lamination position of the hybrid prepregs H2 is not particularly limited.

Meanwhile, it is preferable that the carbon fiber prepregs C composing the golf shaft, that is, the number of carbon fiber prepregs C laminated along the whole length L in the axial direction of the golf shaft, be 3 to 30.

Further, it is preferable that the number of the hybrid prepregs H2 composing the golf shaft be 1 to 10.

Preferably, the carbon fibers contained in the carbon fiber prepregs C are arranged in unidirection in a resin.

Preferably, the carbon fiber prepreg C includes 30 to 70 wt % of carbon fibers and 70 to 30% of the thermosetting resin.

The thermosetting resin may include an epoxy resin, etc.

Preferably, the hybrid prepreg H2 includes 30 to 70 wt % of the aramid fibers and the carbon fibers (based on the total weight of the prepreg) and 70 to 30% of the thermosetting resin.

The thermosetting resin may include an epoxy resin, etc.

The carbon fibers Cf and aramid fibers Af contained in the hybrid prepreg H2 are arranged alternately in unidirection as illustrated in FIG. 5.

It is preferable that the arrangement interval W1 of the carbon fiber Cf contained in the hybrid prepreg H2 be 2 to 10 mm, and the arrangement interval W2 of aramid fiber Af be 2 to 10 mm.

It is preferable that the thickness of the carbon fiber prepreg C and the hybrid prepreg H2 be 50 to 300 μm.

It is preferable that the fineness of the aramid fiber Af be 500 to 3,000 deniers and the fineness of carbon fiber Cf be 300 to 12,000 deniers.

Next, an example of manufacturing a hybrid golf shaft according to the third embodiment of the present invention will be described.

First, a first process, in which the above mentioned carbon fiber prepreg C is wound one time along the whole length L in the axial direction of the mandrel, is carried out two to ten times repeatedly.

Next, a second process, in which the hybrid prepreg H2 is wound one time over the carbon fiber prepreg C wound on the mandrel by the first process, is carried out one to ten times.

Next, a third process, in which the above mentioned carbon fiber prepreg C is wound one time over the hybrid prepreg H2 wound on the mandrel M by the second process is carried out one to twenty times repeatedly, and then the mandrel and the prepreg laminated layer formed on the mandrel are separated after the resin in the prepreg is hardened in a hot-air oven, to manufacture a hybrid golf shaft.

Below the present invention will be described more specifically through examples and comparative examples.

However, the scope of the present invention to be protected is not limited to the examples described below.

EXAMPLE 1

A first process, in which a carbon fiber prepreg C that contains carbon fibers of 5,000 deniers arranged in unidirection and includes 40 wt % of the carbon fiber and 60 wt % of epoxy resin with 150 μm thickness is wound one time in a length section X of 30 cm from the tip end portion of the mandrel M, was carried out.

Next, a second process, in which an aramid prepreg H1 that contains aramid fibers of 1,500 deniers arranged in unidirection and includes 35 wt % of the carbon fiber and 65 wt % of epoxy resin with 200 μm thickness is wound one time in the length section X of 30 cm from the tip end portion of the mandrel, was carried out.

Next, a third process, in which the carbon fiber prepreg C used in the first process is wound one time on the whole section of the mandrel, was carried out ten times repeatedly, and then the mandrel and the prepreg laminated layer formed on the mandrel are separated after the epoxy in the prepreg is hardened in a hot-air oven, to manufacture a hybrid golf shaft.

The length section of 2 cm from the tip end portion of the hybrid golf shaft manufactured as described above was made to be fixed by a vibration measuring device and vibration was applied to a thick side end portion (hereinafter referred to as a "butt end portion") of the golf shaft by a human hand in a vertical direction so as to automatically measure the number of vibrations per minute with the vibration measuring device, and the measured number of vibrations was 218 times/minute.

EXAMPLES 2 TO 10

Except that the length section X, in which the carbon fiber prepreg C and the aramid prepreg H1 are wound from the tip end portion of the mandrel M in the first process and the second process of Example 1, was changed as Table 1, hybrid golf shafts were manufactured in the same way as Example 1.

The results of measuring the manufactured hybrid golf shafts in the same way as Example 1 are as shown in Table 1.

COMPARATIVE EXAMPLE 1

A first process, in which a carbon fiber prepreg C that contains carbon fibers of 5,000 deniers arranged in unidirection and includes 40 wt % of the carbon fiber and 60 wt % of epoxy resin with 150 μm thickness is wound one time in a length section X of 30 cm from the tip end portion of the mandrel M, was carried out two times.

Next, a second process, in which the carbon fiber prepreg C that contains the carbon fibers of 5,000 deniers arranged in unidirection and includes 40 wt % of the carbon fiber and 60 wt % of epoxy resin with 150 μm thickness is wound one time in the whole section of the mandrel, was carried out ten times repeatedly, and then the mandrel and the prepreg laminated layers formed on the mandrel were separated after the epoxy resin in the prepreg was hardened in a hot-air oven, to manufacture carbon fiber prepreg golf shafts.

The length section of 2 cm from the tip end portion of the carbon fiber prepreg golf shaft manufactured as described above was made to be fixed by a vibration measuring device and vibration was applied to the butt end portion of the golf shaft by a human hand in the vertical direction so as to automatically measure the number of vibrations per minute with the vibration measuring device, and the measured number of vibrations was 227 times/minute.

COMPARATIVE EXAMPLES 2 TO 10

Except that the length section X in which the carbon fiber prepreg C is wound from the tip end portion of the mandrel M in the first process of Comparative Example 1 is changed as Table 1, hybrid golf shafts were manufactured in the same way as Comparative Example 1.

The results of measuring the manufactured hybrid golf shafts in the same way as Comparative Example 1 are as shown in Table 1.

TABLE 1

Results of measuring the number of vibrations

| Classification | Length section X (mm) | Number of vibrations (times/minute) |
|---|---|---|
| Example 2 | 5 | 224 |
| Example 3 | 10 | 223 |
| Example 4 | 15 | 222 |
| Example 5 | 20 | 221 |
| Example 6 | 25 | 220 |
| Example 7 | 35 | 219 |
| Example 8 | 40 | 221 |
| Example 9 | 45 | 221 |
| Example 10 | 50 | 221 |
| Comparative Example 2 | 5 | 227 |
| Comparative Example 3 | 10 | 227 |

TABLE 1-continued

| Results of measuring the number of vibrations | | |
|---|---|---|
| Classification | Length section X (mm) | Number of vibrations (times/minute) |
| Comparative Example 4 | 15 | 227 |
| Comparative Example 5 | 20 | 227 |
| Comparative Example 6 | 25 | 227 |
| Comparative Example 7 | 35 | 227 |
| Comparative Example 8 | 40 | 227 |
| Comparative Example 9 | 45 | 227 |
| Comparative Example 10 | 50 | 227 |

EXAMPLE 11

A first process, in which a carbon fiber prepreg C that contains carbon fibers of 5,000 deniers arranged in unidirection and includes 40 wt % of the carbon fiber and 60 wt % of epoxy resin with 150 μm thickness is wound one time along the whole length L in the axial direction of the mandrel, was carried out three times repeatedly.

Next, a second process, in which an aramid prepreg H1 that contains aramid fibers of 1,500 deniers arranged in unidirection and includes 35 wt % of the aramid fiber and 65 wt % of epoxy resin with 200 μm thickness is wound one time on the carbon fiber prepreg C wound on the mandrel by the first process, was carried out only two times.

Next, a third process, in which the carbon fiber prepreg C used in the first process is wound on the aramid prepreg H1 wound on the mandrel by the second process, was carried out two times repeatedly, and then the mandrel and the prepreg laminated layer formed on the mandrel were separated after the epoxy in the prepreg was hardened in a hot-air over, to manufacture a hybrid golf shaft illustrated in FIG. 3.

The length section of 2 cm from the tip end portion of the hybrid golf shaft manufactured as described above was made to be fixed by a vibration measuring device and vibration was applied to the butt end portion of the golf shaft by a human hand in the vertical direction to automatically measure the number of vibrations per minute, and the result was 219 times/minute.

EXAMPLES 12 TO 14

Except that the number of times of carrying out the first process of the third process of Example 11 was changed as Table 2, hybrid golf shafts were manufactured in the same way as Example 11.

The results of measuring the manufactured hybrid golf shafts in the same way as Example 11 are as shown in Table 2.

TABLE 2

| Results of measuring the number of vibrations | | | |
|---|---|---|---|
| Classification | Number of times of carrying out the first process repeatedly (times) | Number of times of carrying out the third process repeatedly (times) | Number of vibrations (times/minute) |
| Example 12 | 10 | 10 | 223 |
| Example 13 | 5 | 8 | 221 |
| Example 14 | 8 | 21 | 222 |

EXAMPLE 15

A first process, in which a carbon fiber prepreg C that contains carbon fibers of 2,000 deniers arranged in unidirection and includes 40 wt % of carbon fiber and 60 wt % of epoxy resin with 150 μm thickness is wound one time along the whole length L in the axial direction of the mandrel, was carried out three times repeatedly.

Next, a second process, in which a hybrid prepreg H2 that contains aramid fibers of 1,500 deniers and carbon fibers of 2,000 deniers arranged in unidirection and includes 35 wt % of the aramid fibers/carbon fibers (based on the total weight of the prepreg) and 65 wt % of epoxy resin with 200 μm thickness is wound one time on the carbon fiber prepreg C wound on the mandrel by the first process, was carried out only one time.

Next, a third process, in which the carbon fiber prepreg C used in the first process is wound one time on the hybrid prepreg H2 wound on the mandrel by the second process, was carried out two times repeatedly, and then the mandrel and the prepreg laminated layer formed on the mandrel are separated after the epoxy in the prepreg is hardened in an hot-air oven, to manufacture a hybrid golf shaft as illustrated in FIG. 4.

The length section of 2 cm from the tip end portion of the hybrid golf shaft manufactured as described above was made to be fixed by a vibration measuring device and vibration was applied to the butt end portion of the golf shaft by a human hand in the vertical direction to measure the number of vibration per minute and the result was 217 times/minute.

EXAMPLES 16 TO 18

Except that the number of times of repeatedly carrying out the first process and the third process of Example 15 was changed as Table 3, hybrid golf shafts were manufactured in the same way as Example 15.

The results of measuring the manufactured hybrid golf shafts in the same way as Example 15 were as shown in Table 3.

TABLE 3

| Results of measuring the number of vibrations | | | |
|---|---|---|---|
| Classification | Number of times of carrying out the first process repeatedly (times) | Number of times of carrying out the third process repeatedly (times) | Number of vibrations (times/minute) |
| Example 16 | 12 | 8 | 218 |
| Example 17 | 7 | 9 | 220 |
| Example 18 | 8 | 21 | 219 |

COMPARATIVE EXAMPLE 11

The process, in which a carbon fiber prepreg C that contains carbon fibers of 5,000 deniers arranged in unidirection and includes 40 wt % of the carbon fiber and 60 wt % of epoxy resin with 150 μm thickness is wound one time in the whole section of the mandrel, was carried out ten times repeatedly, and then the mandrel and the prepreg laminated layer formed on the mandrel were separated after the epoxy in the prepreg was hardened in hot-air oven, to manufacture carbon fiber prepreg shafts.

The length section of 2 cm from the tip end portion of the carbon fiber prepreg golf shaft manufactured as described above was made to be fixed by a vibration measuring device and vibration was given by a human hand in the vertical direction to the butt end portion of the golf shaft to automatically measure the number of vibrations per minute, and the result was 227 times/minute.

INDUSTRIAL APPLICABILITY

The present invention is so excellent in impact absorbability that the number of vibrations in the golf shaft can be remarkably decreased when the golf ball is hit by the golf shaft, so it can be used as a golf shaft.

The invention claimed is:

1. A hybrid golf shaft comprising:

one or more aramid fiber containing prepregs (H) which are laminated in a length section of 5 cm or more of the whole length of the golf shaft; and three or more carbon prepregs (C) which are laminated in a length section of 50 cm or more of the whole length of the golf shaft.

2. The hybrid golf shaft of claim 1, wherein the aramid fiber containing prepreg (H) is an aramid prepreg (H1) which comprises aramid fibers (Af) only.

3. The hybrid golf shaft of claim 2, wherein the carbon fiber prepregs (C) and the aramid prepregs (H1) are laminated in a length section (X) of 5 to 50 cm from a tip end portion of the golf shaft, and only the carbon fiber prepregs (C) are laminated in a remaining section (Y) of the golf shaft excluding the length section (X) of 5 to 50 cm from the tip end portion of the golf shaft.

4. The hybrid golf shaft of claim 3, wherein each of the aramid prepregs (H1) arranged in the length section (X) of 5 to 50 cm from the tip end portion of the golf shaft is laminated between the carbon fiber prepregs (C).

5. The hybrid golf shaft of claim 3, wherein the respective number of the aramid prepregs (H1) and the carbon fiber prepregs (C) laminated in the length section (X) of 5 to 50 cm from the tip end portion of the golf shaft is 1 to 15.

6. The hybrid golf shaft of claim 3, wherein the number of carbon fiber prepregs (C) laminated in a remaining section (Y) of the golf shaft excluding the length section of 5 to 50 cm from the tip end portion of the golf shaft is 3 to 30.

7. The hybrid golf shaft of claim 3, wherein the carbon fiber prepreg (C) comprises 30 to 70 wt % of carbon fibers arranged in unidirection in a thermosetting resin and 70 to 30% of the thermosetting resin.

8. The hybrid golf shaft of claim 4, wherein the aramid prepreg (H1) comprises 30 to 70% of aramid fibers arranged in unidirection in a thermosetting resin and 70 to 30 wt % of the thermosetting resin.

9. The hybrid golf shaft of claim 3, wherein the respective thickness of the carbon fiber prepreg (C) and the aramid prepreg (H1) is 50 to 300 μm.

10. The hybrid golf shaft of claim 2, wherein three or more carbon fiber prepregs (C) and one or more aramid prepregs (H1) are laminated along the whole length (L) in an axial direction of the golf shaft.

11. The hybrid golf shaft of claim 10, wherein the number of the laminated carbon fiber prepregs (C) is 5 to 30.

12. The hybrid golf shaft of claim 10, wherein the number of the laminated aramid prepregs (H1) is 1 to 10.

13. The hybrid golf shaft of claim 10, wherein the carbon fiber prepreg (C) comprises 30 to 70 wt % of carbon fibers arranged in unidirection in a thermosetting resin and 70 to 30% of the thermosetting resin.

14. The hybrid golf shaft of claim 10, wherein the aramid prepreg (H1) comprises 30 to 70% of aramid fibers arranged in unidirection in a thermosetting resin and 70 to 30 wt % of the thermosetting resin.

15. The hybrid golf shaft of claim 10, wherein the respective thickness of the carbon fiber prepreg (C) and the aramid prepreg (H1) is 50 to 300 μm.

16. The hybrid golf shaft of claim 1, wherein the aramid fiber containing prepreg (H) is a hybrid prepreg (H2) which comprises aramid fibers (Af) and carbon fibers (Cf).

17. The hybrid golf shaft of claim 16, wherein (i) three or more carbon fiber prepregs (C) and (ii) one or more hybrid prepregs (H2) comprising the carbon fibers (Cf) and the aramid fibers (Af) are laminated along the whole length (L) in the axial direction of the golf shaft.

18. The hybrid golf shaft of claim 17, wherein the number of the laminated carbon fiber prepregs (C) is 5 to 30.

19. The hybrid golf shaft of claim 17, wherein the number of the laminated hybrid prepreg (H2) is 1 to 10.

20. The hybrid golf shaft of claim 17, wherein the carbon fiber prepreg (C) comprises 30 to 70 wt % of carbon fibers arranged in unidirection in a thermosetting resin and 70 to 30% of the thermosetting resin.

21. The hybrid golf shaft of claim 17, wherein the carbon fibers (Cf) and the aramid fibers (Af) contained in the hybrid prepreg (H2) are arranged alternately in unidirection.

22. The hybrid golf shaft of claim 17, wherein the hybrid prepreg (H2) comprises 30 to 70 wt % of the aramid fibers/the carbon fibers (based on the total weight of the prepreg) arranged alternately in unidirection in a thermosetting resin and 70 to 30 wt % of the thermosetting resin.

23. The hybrid golf shaft of claim 17, wherein the respective thickness of the carbon fiber prepreg (C) and the hybrid prepreg (H2) is 50 to 300 μm.

24. The hybrid golf shaft of claim 17, wherein an arrangement interval (W1) of the carbon fibers (Cf) contained in the hybrid prepreg (H2) is 2 to 10 mm, and an arrangement interval (W2) of the aramid fibers (Af) is 2 to 10 mm.

* * * * *